US007287552B2

(12) United States Patent
Debaes et al.

(10) Patent No.: US 7,287,552 B2
(45) Date of Patent: Oct. 30, 2007

(54) PROCESS FOR WEAVING FABRICS AND SHAGGY FABRICS

(75) Inventors: Johny Debaes, Moorslede (BE); Marc Delepierre, Lauwe (BE)

(73) Assignee: N.V. Michele Van de Wiele, Kortrijk/Marke (BE)

( * ) Notice: Subject to any disclaimer, the term of this patent is extended or adjusted under 35 U.S.C. 154(b) by 41 days.

(21) Appl. No.: 11/290,616

(22) Filed: Nov. 30, 2005

(65) Prior Publication Data

US 2006/0137758 A1 Jun. 29, 2006

(30) Foreign Application Priority Data

Dec. 2, 2004 (BE) ..... 2004/0590

(51) Int. Cl.
*D03D 39/16* (2006.01)
*D03D 39/10* (2006.01)
*D03D 11/00* (2006.01)

(52) U.S. Cl. ..... 139/21; 139/37; 139/387 R; 139/191; 139/397; 139/413

(58) Field of Classification Search ..... 139/21, 139/37, 383 R, 391, 397, 403, 407–409, 139/413, 418
See application file for complete search history.

(56) References Cited

U.S. PATENT DOCUMENTS 2,095,382 A * 10/1937 Drobile ..... 139/21
2,182,610 A * 12/1939 Calonnier ..... 139/397
2,497,716 A * 2/1950 Bloch et al. ..... 428/92
2,905,202 A * 9/1959 Hoeselbarth ..... 139/39
2,929,413 A * 3/1960 Hoeselbarth ..... 139/406

(Continued)

FOREIGN PATENT DOCUMENTS

EP 0919652 6/1999

(Continued)

*Primary Examiner*—Gary L. Welch
*Assistant Examiner*—Robert H Muromoto, Jr.
(74) *Attorney, Agent, or Firm*—James Creighton Wray; Clifford D. Hyra

(57) ABSTRACT

The invention relates, on the one hand, to a process for weaving fabrics on a weaving machine, wherein these fabrics comprise a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application and are inwoven or float along the fabric for non-figuring application, wherein a bottommost and a topmost fabric (20), (10) are woven according to a double-face weaving method, and the said two mutually adjacent warp yarn systems each comprise the same at least two pile warp yarns (17), (18), (21), (22), (23), (24), (25), (26), in which case, if the one pile warp yarn in the first warp yarn system (17), (21), (23), (25) in non-figuring application, floats or is inwoven in the top fabric (10), respectively bottom fabric (20), the corresponding pile warp yarn from the other warp yarn system (17), (21), (23), (25), in non-figuring application, floats or is inwoven in the bottom fabric (20), respectively top fabric (10). On the other hand, the invention relates to a shaggy fabric which is woven on a double-face weaving machine.

17 Claims, 8 Drawing Sheets

U.S. PATENT DOCUMENTS 3,327,738 A * 6/1967 Sabbe ..... 139/398
3,519,032 A * 7/1970 Sabbe ..... 139/398
5,398,730 A * 3/1995 Derudder et al. ..... 139/21
5,465,761 A * 11/1995 Gheysen ..... 139/21
6,182,708 B1 * 2/2001 Smissaert ..... 139/21
6,336,475 B2 * 1/2002 Dewispelaere et al. ..... 139/391
6,343,626 B1 * 2/2002 Demey et al. ..... 139/398
7,086,424 B2 * 8/2006 Debaes et al. ..... 139/418
2001/0010236 A1 * 8/2001 Dewispelaere et al. ..... 139/391
2001/0050112 A1 * 12/2001 Smissaert ..... 139/383 A
2006/0118196 A1 * 6/2006 Debaes et al. ..... 139/11
2006/0137758 A1 * 6/2006 Debaes et al. ..... 139/11
2007/0006932 A1 * 1/2007 Mertens et al. ..... 139/37

FOREIGN PATENT DOCUMENTS

EP 1046734 10/2000

* cited by examiner

PROCESS FOR WEAVING FABRICS AND SHAGGY FABRICS

This application claims the benefit of Belgian Application No. 2004/0590 filed Dec. 2, 2004, which is hereby incorporated by reference in its entirety.

The present invention relates to a process for weaving fabrics on a weaving machine, these fabrics comprising a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application and are inwoven or float along the fabric for non-figuring application.

By a warp yarn system is meant a group of warp yarns comprising: tension warp yarns, binder warp yarns and/or pile warp yarns, these warp yarn systems extending side by side in the weft direction. By characteristics is meant type, color, thickness, etc.

The present invention further relates to a shaggy fabric.

Shaggy fabrics, or, indeed, shag fabrics as they are also called, are fabrics in which coarse, long pile warp yarns are used. The pile height ranges from 15 mm to 100 mm. The thickness of the yarns starts from 3000 denier and may run to 12000 denier, and even to 30 000 denier. Sometimes, in shaggy fabrics of this type, yarns are also used in which a thick and a thin yarn are made into one yarn in order to create additional effects.

Shaggy fabrics have hitherto primarily been made from wool, hand-tufted or woven on single-piece weaving machines such as rod looms or Axminster looms. Such fabrics do not however lend themselves to being woven on double-face weaving machines, since the thick pile warp yarns cannot be woven in the traditional 2-pick and 3-pick weaves, since the thick pile warp yarns are difficult to conceal in the fabric, and since, in the realizations of fabrics with longer pile height (more than 30 mm), the drawbacks arise that the pile strength is insufficient and the yarn supply which must be delivered within one machine cycle by the bobbin in the weaving creel becomes excessive as a result of the movement of the pile from the top weave to the bottom weave. Moreover, this latter drawback, depending on the pattern to be woven, ensures a heavy load upon the jacquard device.

In rod-weaving, these problems arise less, since the quantity of pile warp yarns which has to be delivered within a machine cycle is more limited due to the fact that only one fabric is woven and the machine speed, moreover, is lower. In Axminster weaving, too, these problems arise less, since the pile warp yarn has also only to be supplied for one fabric, the weaving speed is lower, and a pile is used only around the three wefts. Furthermore, nor does the problem arise of dead pile.

Both rod-weaving and Axminster weaving, however, have a significantly lower weaving yield than double-face weaving. To date, moreover, none of these techniques have been used to weave or tuft shaggy fabrics in the cheaper plastic or polypropylene yarns; in the case of rod-weaving, because the temperature which is generated as the rods are withdrawn rises too high to be able to use plastic or polypropylene yarns; in the case of Axminster weaving, because the gripper systems are not suited to the reception and use of these yarns.

For a person skilled in the art, it is not obvious to weave in double-face thick wool or polypropylene yarns in a plurality of colors. If shaggy fabrics are woven in double-face in the traditional 1/2 V-weave, which is the most common weave in double-face weaving, then the occupancy level of the pile warp yarns is too high, so that the yarns are difficult to weave into the fabric. The pile warp yarns are in this case pressed too close together and there is insufficient space to conceal the dead pile warp yarns in the fabric, which makes it difficult to produce a nice design on the back of the fabric. Moreover, fabrics of such density are hard and give the user an uncomfortable feel. In addition, such fabrics are too expensive as a result of the high quantity of raw materials. Furthermore, the V-weave has a pile strength which becomes insufficient in respect of longer pile.

Such problems as regards density and pile strength are resolved in flat velvet-weaving by the use of, for example, W-weaves, which give an excellent pile strength (see, in this regard, Van de Wiele Weave Catalogue, pp. 1, 8 and 38). However, for a person skilled in the art, it is not obvious to proceed to use this technique in combination with jacquard and color selection according to an arbitrary pattern.

SUMMARY OF THE INVENTION

It is an object of the present invention, on the one hand, to provide a process for producing a high-pile fabric in thick pile yarns, wherein such fabrics, for example shaggy fabrics, can be produced on a double-face jacquard loom, wherein cheap plastic and polypropylene yarns can also be used, and wherein different effects, such as, for example, different colors and different yarn types, or reliefs, etc., can be realized in the fabric.

This object is achieved according to the invention by providing a process having the characteristics defined in the first paragraph of this description, wherein a bottommost and a topmost fabric are woven according to a piece double weaving method, and the said two mutually adjacent warp yarn systems each comprise the same at least two pile warp yarns, in which case, if the one pile warp yarn in the first warp yarn system in non-figuring application, floats or is inwoven in the top fabric, respectively bottom fabric, the corresponding pile warp yarn from the other warp yarn system, in non-figuring application, floats or is inwoven in the bottom fabric, respectively top fabric.

In this way, if two neighboring warp yarn systems are considered, a good spread is obtained of the piling in each fabric, in other words, over two mutually adjacent warp yarn systems a figuring pile extends virtually between each two successive wefts in one and the same fabric.

This process allows fabrics which comprise pile warp yarns with different characteristics, for example color, thickness, effect, to be woven with long and thick pile according to an arbitrary weaving pattern, such that, in areas in which primarily yarns are figure-forming which are inwoven or float in the same fabric, no markings occur as a result of areas of weft threads over which no figuring pile warp thread is interlaced, and wherein the figuring remains accurate if the characteristics of the pile warp threads are changed, for example in the event of a color shift.

The fabrics which are woven according to the process according to the invention can be woven by means of weaves according to the formula $2k+3/2(2k+3)$, wherein $k>0$ and k is a whole number.

The fabrics are generally woven on a double-face, double-rapier weaving machine having two weft insertion means and weft insertion levels, two weft insertion means being simultaneously introduced per machine cycle.

Such weaves exhibit excellent pile strength and, in application of the process of the invention, result in a nice figuring and a nice back of the carpet. However, the use of these weaves ensures that in specific successive weft insertion cycles the change of shed calls for changes in position of specific yarns from a position above the topmost weft insertion level to a position below the bottommost weft insertion level. If the pile is long, this means that, for this positional shift, the bobbins in the weaving creel which supply the yarn must supply a very large quantity of yarn, i.e. more than twice the pile height of one fabric, within a short period, i.e. in one machine cycle.

For this reason, greater preference is given to fabrics which are woven by means of weaves according to the formula 2k+1/4(k+1), wherein k≧0, k being a whole number.

These weaves offer the advantage that, when the pile is drawn between the top and the bottom fabric in at least one intermediate machine cycle, the figuring pile warp yarns assume an intermediate position situated between the topmost and the bottommost weft insertion level. This has the advantage both that the load upon the jacquard device is reduced and that lesser demands are placed upon the yarn supply from the weaving creel than with a traditional 1/2 V-weave or than with the weaves according to the formula 2k+3/2(2k+3), wherein k≧0, where the yarn supply for bridging the distance between the top and the bottom fabric has to take place in one machine cycle.

A further improvement in density with the process according to the invention consists in weaving the fabrics by a combination of weaves according to one of the formulae 2k+3/2(2k+3) and 2k+1/4(k+1), wherein k≧0 and k is a whole number, the figuring for the top fabric being realized according to a weave having a specific k-value according to one of the said formulae, and the figuring for the bottom fabric being realized according to a weave having a differing k-value according to the same formula.

In this way, in areas in which this combination is used, a different pile density can be achieved than with each of the weaves separately according to one of the abovementioned formulae, each of the weaves with the figuring pile warp yarns acting alternately in the bottom fabric and top fabric, respectively over an equal number of wefts for figuring in the bottom fabric and the top fabric.

Another variant which allows additional effects to be created in a fabric, in the process according to the invention in a weave according to one of the abovementioned formulae, consists in displacing the transition from figuring of a pile warp yarn in the top fabric to figuring of this pile warp yarn in the bottom fabric over one or more extra wefts, the pile warp yarn at each of these extra wefts being placed in a middle position between the weft insertion levels.

In this way, the pile length of the figuring pile warp yarn between the interlacing in the top fabric and the interlacing in the bottom fabric becomes longer than if the transition from figuring of a pile warp yarn in the top fabric to figuring of this pile warp yarn in the bottom fabric runs over one weft, whereby longer pile is obtained.

In this case, the cutting quality of the cutting blade, as well as the next transition of figuring pile warp yarn between the top and bottom fabric, will jointly determine the correct distribution of the pile length between the top and bottom fabric. High-low effects can thus be realized in those areas in the fabric which have cut pile.

In a preferred process according to the invention, one warp yarn system extends through one reed dent of the reed of the weaving machine.

In order further to increase the density of the said weaves according to both formulae and combinations thereof, a preferred process can be applied in which, in at least two mutually adjacent warp yarn systems, in each of these warp yarn systems for one or more pile warp yarns, a pile warp yarn with the same characteristics is present, whereby weaving can be conducted in opposite phase.

In order to increase the density still further, in at least two mutually adjacent warp yarn systems, in each of these warp yarn systems, for each pile warp yarn a pile warp yarn with the same characteristics is present, whereby weaving can be conducted fully in opposite phase. The process in opposite phase has the characteristic that, for each upward movement of a pile warp yarn, a pile warp yarn with the same characteristic in the same warp yarn system moves downwards.

If weaving is conducted in opposite phase in the fabric, then in these areas, inherently, a guaranteed pile density uniformity is realized. In this case, in a preferred process-according to the invention, the weave-pattern in mutually adjacent warp yarn systems is displaced over one or more wefts. In this way, the equality in pile density is further increased.

However, the weaving in opposite phase halves the number of different yarn types which can be employed for one and the same jacquard and weaving creel capacity.

Since, for fabric structures which are woven fully in opposite phase, for each movement of a pile warp yarn, a pile warp yarn with the same characteristic performs a counter-movement, a jacquard device can be used in which each movement of a pile warp yarn is coupled, by an active selection of one or more selection elements of the jacquard device, to an opposite movement of a pile warp yarn with the same characteristic, so that, for the movement of this pile warp yarn with the same characteristic, no selection by one or more selection elements needs to be made. This allows these weaves to be realized with a jacquard device having only half the number of selection elements.

When weaving is conducted fully in opposite phase, the weave pattern in mutually adjacent warp yarn systems is preferably displaced over the number of wefts, in which case, if the figuring pile warp yarns in the first warp yarn system move between the bottom fabric and the top fabric, in the adjoining warp yarn system the figuring pile warp yarns form the middle leg of the W-weave pattern.

Striping resulting from a fabric line having a weft over which, for example, only middle legs of W-shaped piles are interlaced is thereby prevented.

For the sake of the thickness of the yarns, the pile warp yarns in the fabrics are provided, preferably floating, on the pile side of the fabrics and are interlaced at regular intervals over a weft which is located, in relation to the tension warp yarn consisting of the ground fabric of the fabric, on the pile side of the fabric.

In order to reach the middle position in a plurality of successive positions, on the one hand open-shed jacquard devices can be used which can assume any position on every insertion cycle.

On the other hand, a jacquard device can be used which can only reach the middle position over a plurality of weft insertion cycle and which can move from the middle position on the one weft insertion cycle to the topmost or bottommost position, and on the following weft insertion cycle moves back to the middle position.

On the other hand, it is an object of the present invention to provide a shaggy fabric, wherein, in this shaggy fabric cheap plastic and polypropylene yarns can be used and wherein, in the fabric, different effects such as different colors, reliefs, etc. can be realized.

This object is achieved according to the invention by providing a shaggy fabric, the shaggy fabric having been woven with pile warp yarns in a plurality of colors or effects on a double-face weaving machine.

More specifically, the shaggy fabric is woven by means of a process according to the invention as defined above.

In a preferred embodiment of a shaggy fabric according to the invention, in the fabric in mutually adjacent warp yarn systems the pile-forming portion of the weave pattern lies displaced over a plurality of wefts one relative to the other.

The said displacement in mutually adjacent warp yarn systems is here preferably equal to half the number of wefts over which the weave pattern is repeated.

In this way, the figuring by the pile warp yarns of a first warp yarn system is complementary with the figuring by the pile warp yarns of a neighboring warp yarn system.

In the detailed description which follows below, the aforementioned characteristics and advantages of a process for weaving fabrics according to the invention and fabrics woven according to a process according to the invention are further explained. The aim of this invention is merely to illustrate the general principles of the present invention, so that nothing in this description can be interpreted as limiting the field of application of the invention or of the patent rights claimed in the claims.

In this description, reference is made by means of reference numerals to FIGS. 1 to 17 appended hereto, in which:

DETAILED DESCRIPTION OF THE PREFERRED EMBODIMENTS

In double-piece jacquard weaving, pile warp yarns with different characteristics such as color, thickness, effect, etc. are used, which are woven into a fabric according to a specific weaving pattern. Each type of pile warp yarn is present in each warp yarn system. As previously stated, by a warp yarn system is meant a group of warp yarns comprising: tension warp yarns, binder warp yarns, and/or pile warp yarns, these warp yarn systems extending side by side in the weft direction. By means of the jacquard device, each pile warp yarn can be placed in its correct position in the shed to realize the desired weaving pattern when the weft yarns are inserted and the reed is beaten up. For fabrics having cut pile in the traditional 1/2 V-weave, the different types of yarns are present once in each warp yarn system and all pile warp yarn systems are identically constructed.

In velvet-weaving, however, other weaves are known, the pile being less densely applied by making the weave work over a plurality of wefts. A good example of such a weave is the W-weave. This weave is not used, however, in double-face jacquard velvet-weaving. Accordingly, these weaves are used only in plain fabrics having pile warp yarns with the same characteristics. Free patterning with all pile warp yarns with different characteristics which are distributed over the top and bottom work so as, in the case of non-figuring pile, to be interlaced in these fabrics or float therein has hitherto not been possible with the attainment of acceptable fabric qualities.

The problem which presents itself is that, with such a weave over a plurality of wefts, respectively over a number of wefts in the top fabric and over a number of wefts in the bottom fabric, no single pile warp yarn is interlaced in figuring application, and that the figuring in the top and bottom fabric runs displaced over a plurality of wefts, this displacement being smaller than the repeat pattern.

Figure 1:
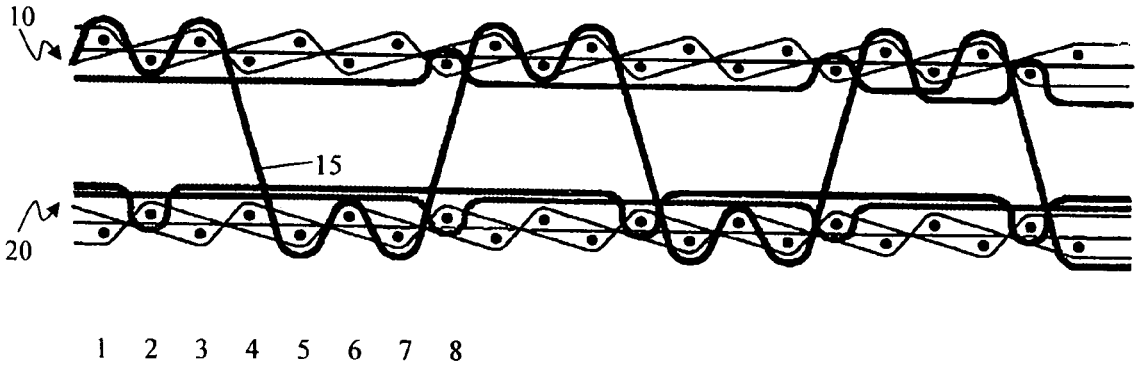
FIG. 1 represents the repetitive weave pattern of the 3/8 W-weave in the production of fabrics.

Thus, for a 3/8 W-weave (as is represented in FIG. 1), if a pile warp yarn (15) which is inwoven or floats in the top fabric (10) becomes figuring, this pile warp yarn (15) will start on forming a W-pile in the top fabric (10) over the first three wefts (1-3). After this, this pile warp yarn (15) is no longer present in the top fabric (10) over the following five wefts (4-8). On warp 5 to 7, this pile warp yarn (15) forms a W-pile in the bottom fabric (20), and from weft 8 to 12 (=weft 8 to 4 within the repetition record) is no longer present in the bottom fabric (20).

A pile warp yarn which starts up from the bottom fabric (20) (not represented in the figure) will on the first three wefts form a W-pile in the bottom fabric (20), after which, on wefts 5 to 7, a W-pile is formed in the top fabric (10), on wefts 4 to 8 for the bottom fabric and on wefts 8 to 12 for the top fabric this pile warp yarn (14) no longer being present.

Figure 2:
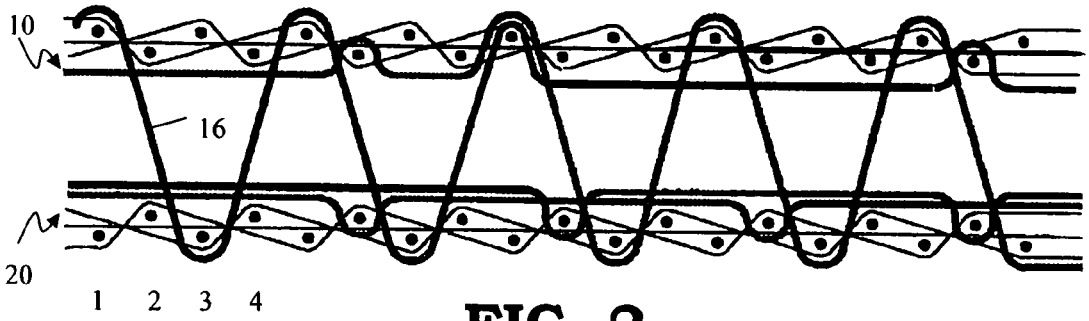
FIG. 2 represents the repetitive weave pattern of the 1/4 V-weave in the production of fabrics.

This means that in fabrics according to a weave of the type represented in FIG. 1, if a figuring pile warp yarn (15) is selected, this pile warp yarn (15), both in the top fabric (10) and in the bottom fabric (20), respectively over three wefts (1-3), lays a W-pile, and additionally over 5 wefts (4-8) lays no pile. Such fabrics have the drawback that they do not allow a nice weaving pattern to be formed, nor a nice back to be realized on the fabric. In a 1/4 V weave, as is represented in FIG. 2, something similar also occurs. If for the top fabric (10), for example, by a figuring pile warp yarn (16), a V-pile is interlaced on weft 1, then, by this figuring pile warp yarn (16), over wefts 2 to 4, no V-pile will be interlaced in the top fabric (10), whereas, for the bottom fabric (20), the figuring pile warp yarn (16) will interlace no V-pile on weft 1, 2 and 4, and on weft 3, by this figuring pile warp yarn (16), a V-pile will be interlaced in the bottom fabric. In this case, for each fabric, V-pile will be formed respectively over one weft and not over three wefts.

Figure 3:
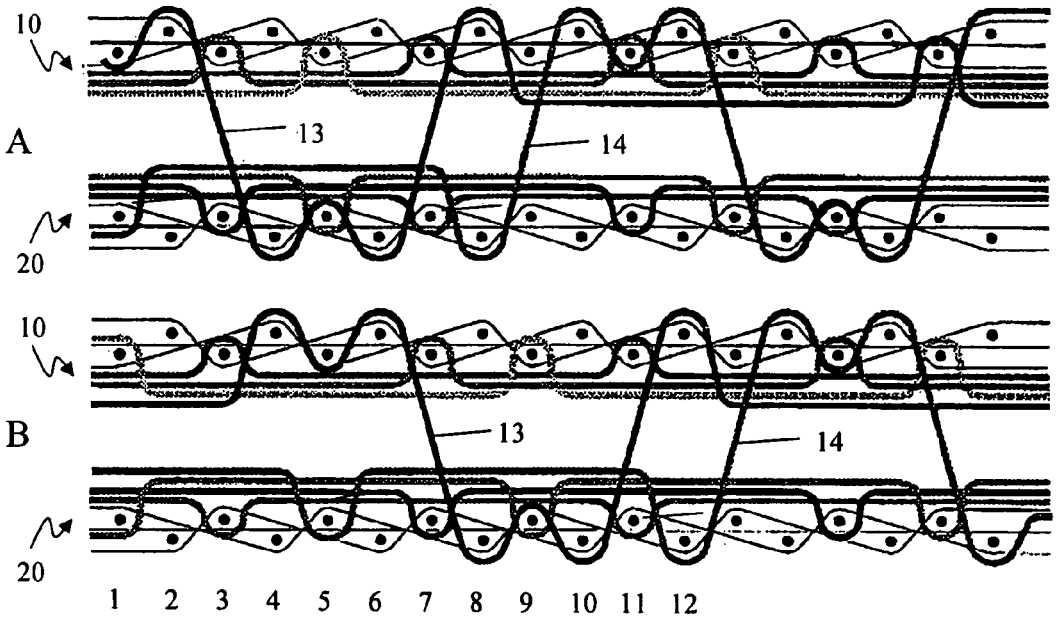
FIG. 3 represents the diagrammatic cross section of fabrics, in adjoining warp yarn systems for each fabric the corresponding pile warp yarn with the same characteristic interlacing a number of wefts with the same weave structure, whilst the pile warp yarn in non-figuring application in both warp yarn systems is floating in the same fabric.
Figure 4:
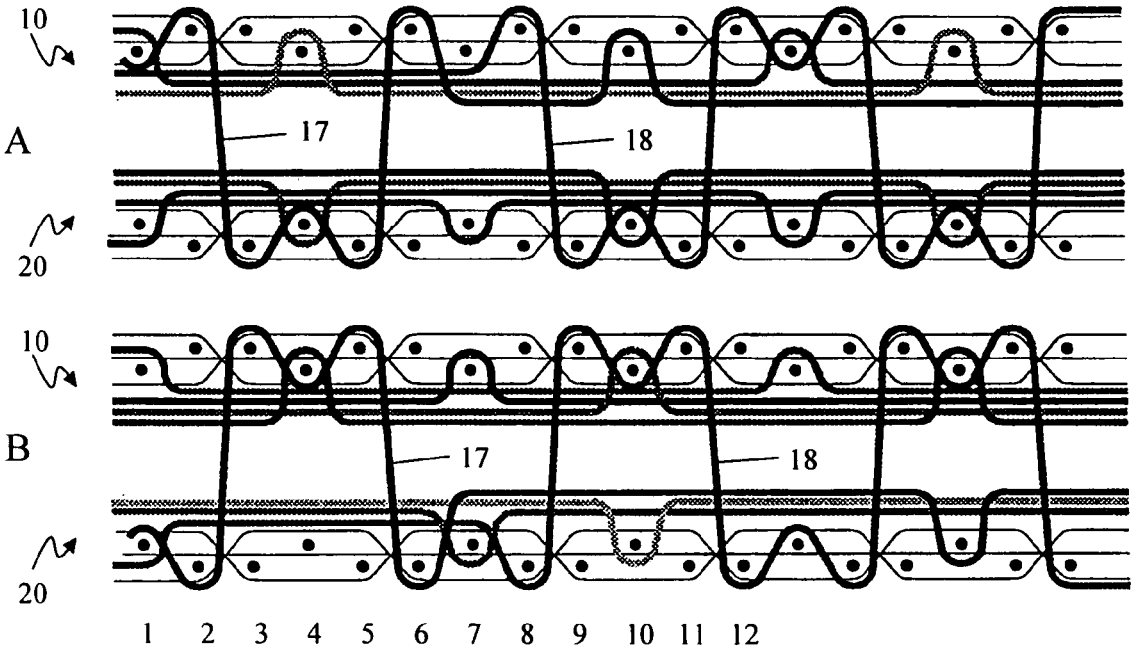
FIG. 4 represents the diagrammatic cross section of a first embodiment of shaggy fabrics woven with the 3/6 W-weave by means of the process according to the invention.
Figure 5:
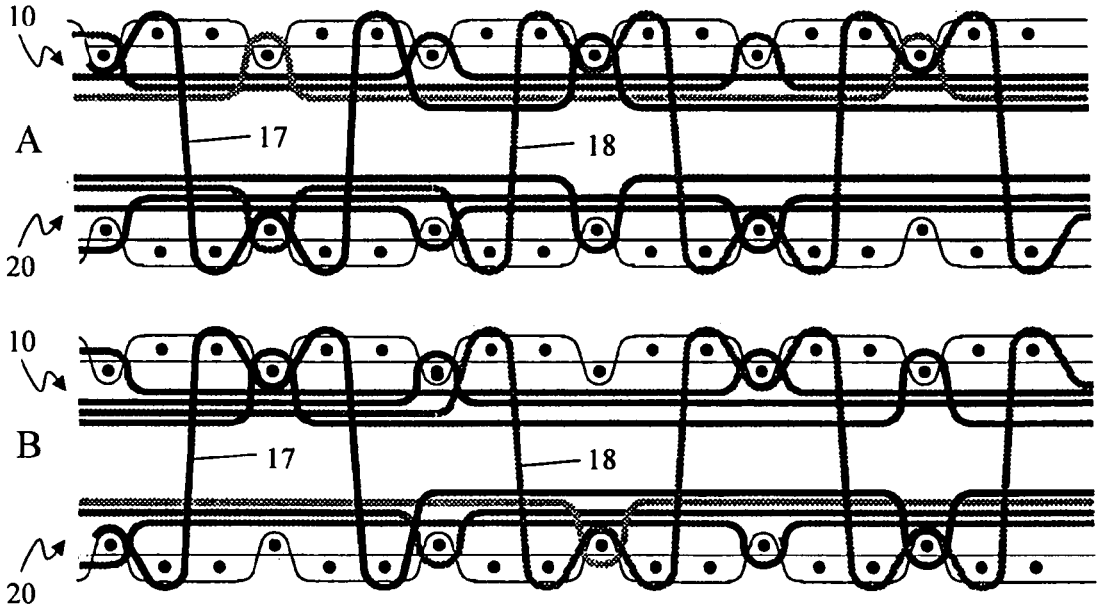
FIG. 5 represents the diagrammatic cross section of a second embodiment of shaggy fabrics woven with the 3/6 W-weave by means of a process according to the invention.
Figure 6:
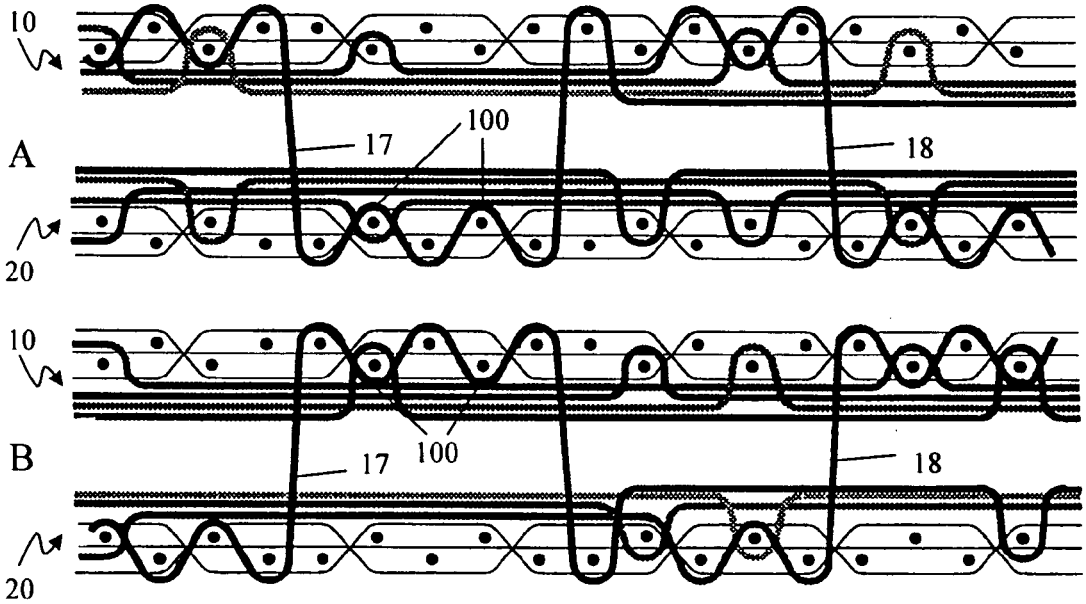
FIG. 6 represents the diagrammatic cross section of shaggy fabrics woven with the 5/10 W-weave by means of a process according to the invention.
Figure 7:
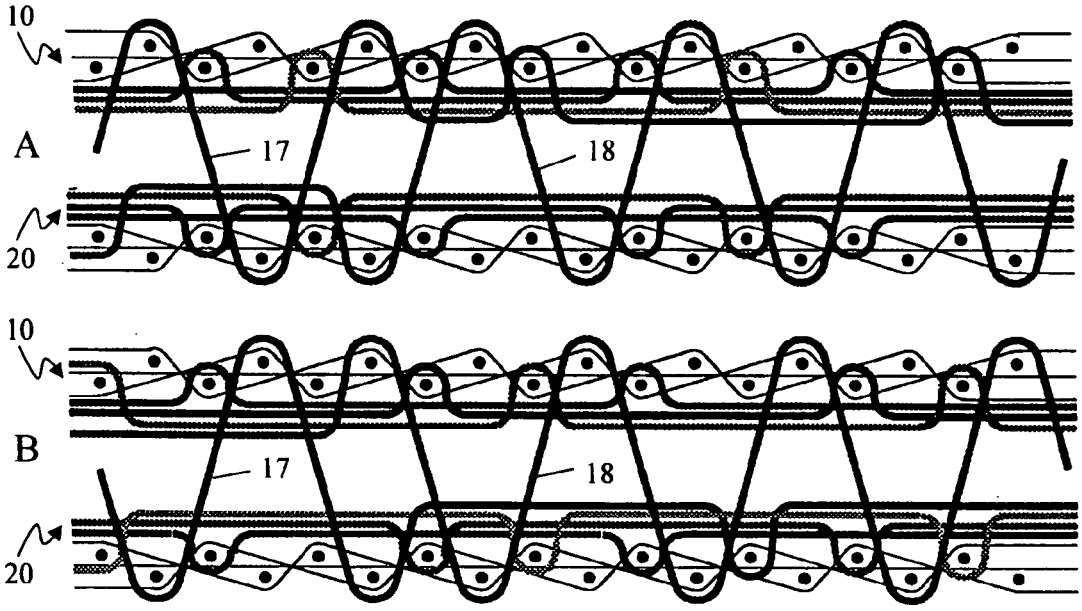
FIG. 7 represents the diagrammatic cross section of shaggy fabrics woven with the 1/4 V-weave by means of a process according to the invention.
Figure 8:
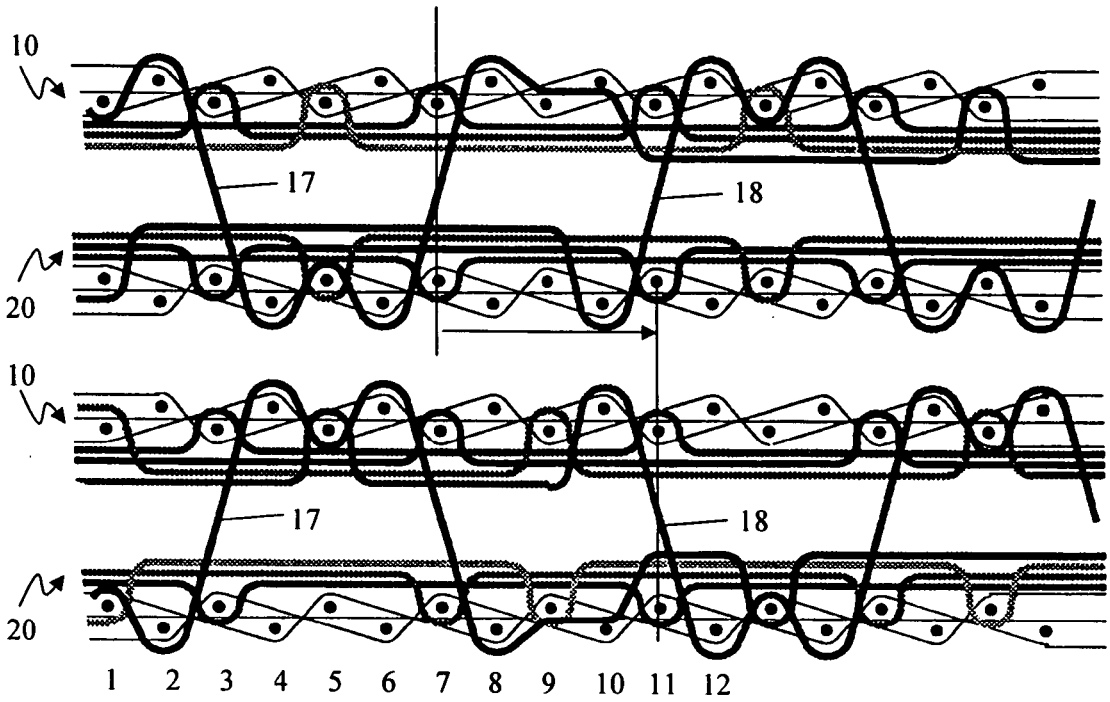
FIG. 8 represents the diagrammatic cross section of shaggy fabrics woven with the 3/8 W-weave by means of a process according to the invention.
Figure 9:
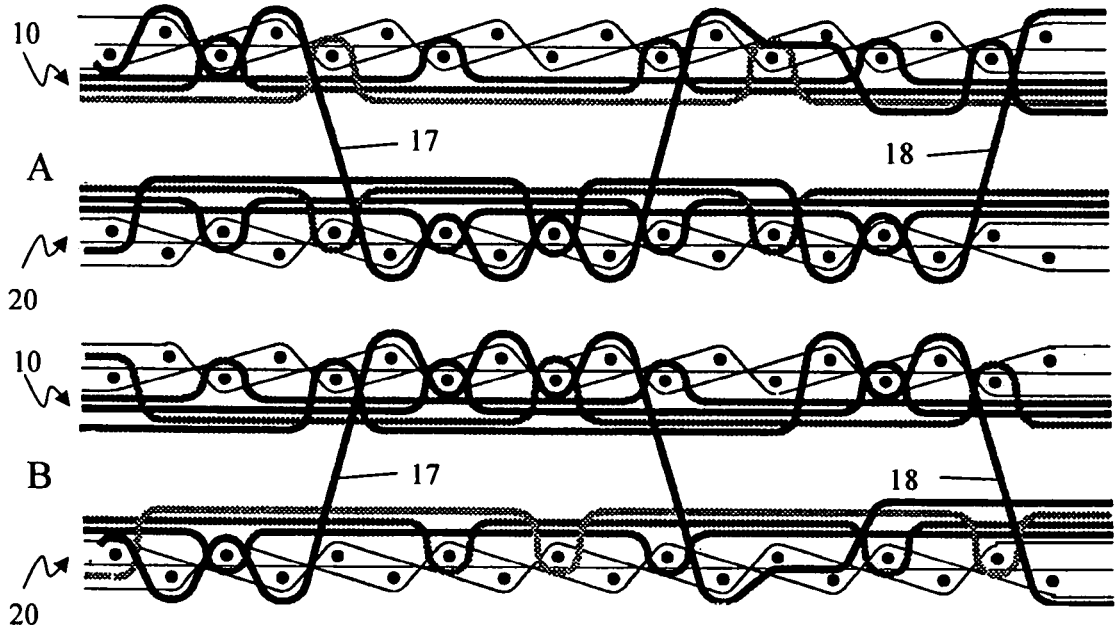
FIG. 9 represents the diagrammatic cross section of shaggy fabrics woven with the 5/12 W-weave by means of a process according to the invention.
Figure 10:
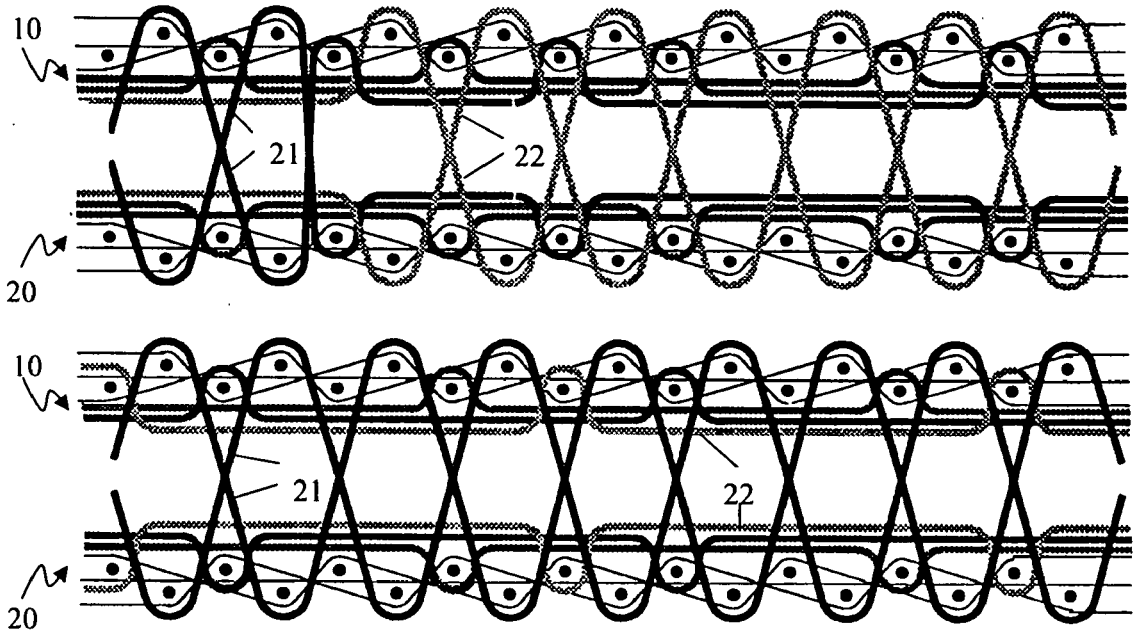
FIG. 10 represents the diagrammatic cross section of a first embodiment of shaggy fabrics woven in opposite phase by means of a process according to the invention.
Figure 11:
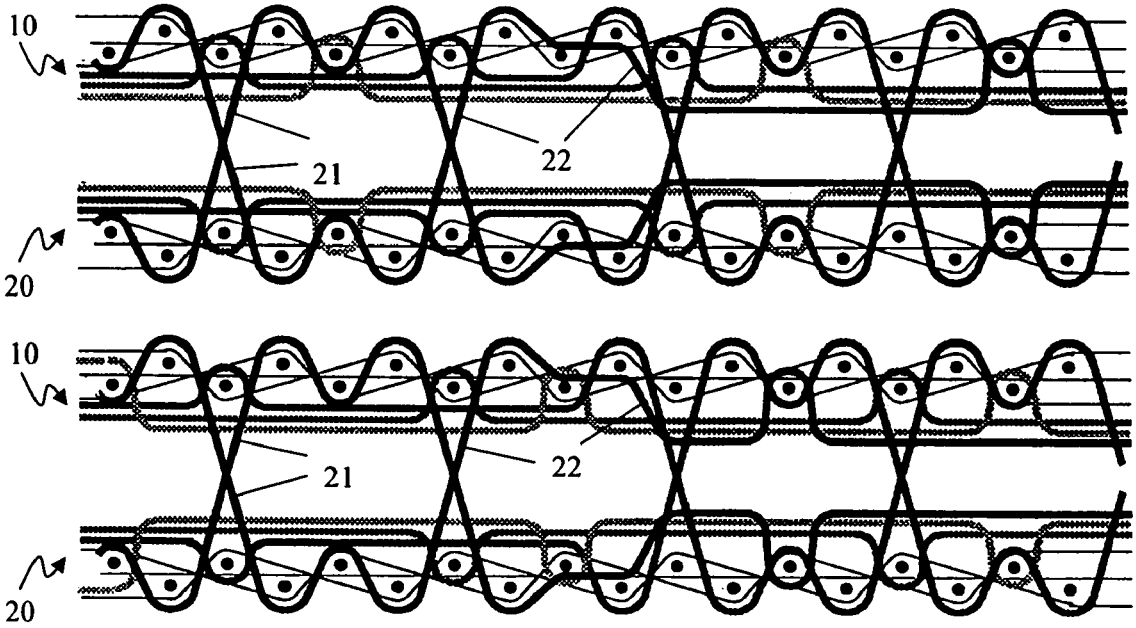
FIG. 11 represents the diagrammatic cross section of a second embodiment of shaggy fabrics woven in opposite phase by means of a process according to the invention.

As is represented in FIG. 3, an attempt could be made to remedy the adverse effects upon the figuring and the back by, in adjoining warp yarn systems (A), (B), for each fabric (10), (20), making the corresponding pile warp yarn (13), (14) with the same characteristic start a number of wefts later with the same weave structure. In FIG. 3, this is represented on the basis of a 3/8 W-weave. It is herein found, however, that in the event of a change of figuring between a first pile warp yarn (13) which, in non-figuring application, floats in the top fabric (10), and a second pile warp yarn (14) which, in non-figuring application, floats in the bottom fabric (20), the change, in mutually adjacent warp yarn systems (A), (B), is displaced over 4 wefts. This is, however, a serious restriction upon the quality of figuring in the fabric and is unacceptable for high-quality applications, certainly where the figuring comprises distinguished lines.

The general inventive concept consists in a topmost and a bottommost shaggy fabric being woven according to a double-face weaving method involving pile warp yarns with different colors and effects, these fabrics comprising a plurality of warp yarn systems, wherein for at least two mutually adjacent warp yarn systems, in each of these at least two warp yarn systems, at least two pile warp yarns with different characteristics are present, and wherein in each of the said warp yarn systems the pile warp yarns are interlaced alternately in the fabric, according to a pattern, for figuring application, and are inwoven or float along the fabric for non-figuring application, wherein the said two mutually adjacent warp yarn systems each comprise the same at least two pile warp yarns, in which case, if the one pile warp yarn in the first warp yarn system, in non-figuring application, floats or is inwoven in the top fabric (10), respectively bottom fabric (20), the corresponding pile warp yarn from the other warp yarn system, in non-figuring application, floats or is inwoven in the bottom fabric (20), respectively top fabric (10). By characteristics is meant color, type, thickness, structure, etc.

This basic principle will be illustrated in greater detail in FIGS. 4 to 17, in which, respectively, a diagrammatic cross section is shown of a double-piece fabric according to the present invention, during the production thereof on a double-face jacquard loom.

The basic principle of the invention as defined above can be applied to fabrics which are woven by means of weaves according to the formula $2k+3/2(2k+3)$, wherein $k \geqq 0$ and k is a whole number. This encompasses the 3/6 W-weave (FIGS. 4 and 5), the 5/16 W-weave (with two middle legs (100) on the "W") (FIG. 6), the 7/12 W-weave (with 3 middle legs on the "W"), etc.

For the above-stated reasons, however, preference is given to fabrics according to the formula $2k+1/4(k+1)$, wherein $k \geqq 0$ and k is a whole number. Such weaves are the 1/4 V-weave (FIG. 7, the 3/8 W-weave (FIG. 8), the 5/12 W-weave (FIG. 9), 7/16 W-weave, etc.

In order further to increase the density of the weaves according to the two formulae $2k+3/2(2k+3)$ and $2k+1/4(k+1)$, wherein $k>0$ and k is a whole number, in at least two mutually adjacent warp yarn systems, in each of these warp yarn systems, for one or more pile warp yarns, a pile warp yarn with the same characteristics can be provided. In this way, weaving can be conducted in opposite phase. The choice can thus be made, for example, to provide the primary colors and effects doubly and to provide the secondary colors and effects only singly.

If, however, a still greater density is desired, in at least two mutually adjacent warp yarn systems, for each pile warp yarn, a pile warp yarn with the same characteristics can be provided, whereby weaving can be conducted fully in opposite phase. In the case of weaves which are realized in opposite phase, the rule applies that, for each pile warp yarn extending from the top fabric (10) to the bottom fabric (20), a corresponding pile warp yarn extends from the bottom fabric (20) to the top fabric (10). In a process according to the invention, in the opposite phase weaving of each pair of pile warp yarns, one pile warp yarn, in non-figuring application, is provided inwoven or floating in the bottom fabric (20), whilst the corresponding pile warp yarn with the same characteristic, in non-figuring application, is provided inwoven or floating in the top fabric (10). The pile density is thereby doubled, whilst all the advantages of the process according to the invention are maintained. However, the number of possible characteristics which can be present in one fabric is thereby halved, given the same jacquard capacity.

Figure 12:
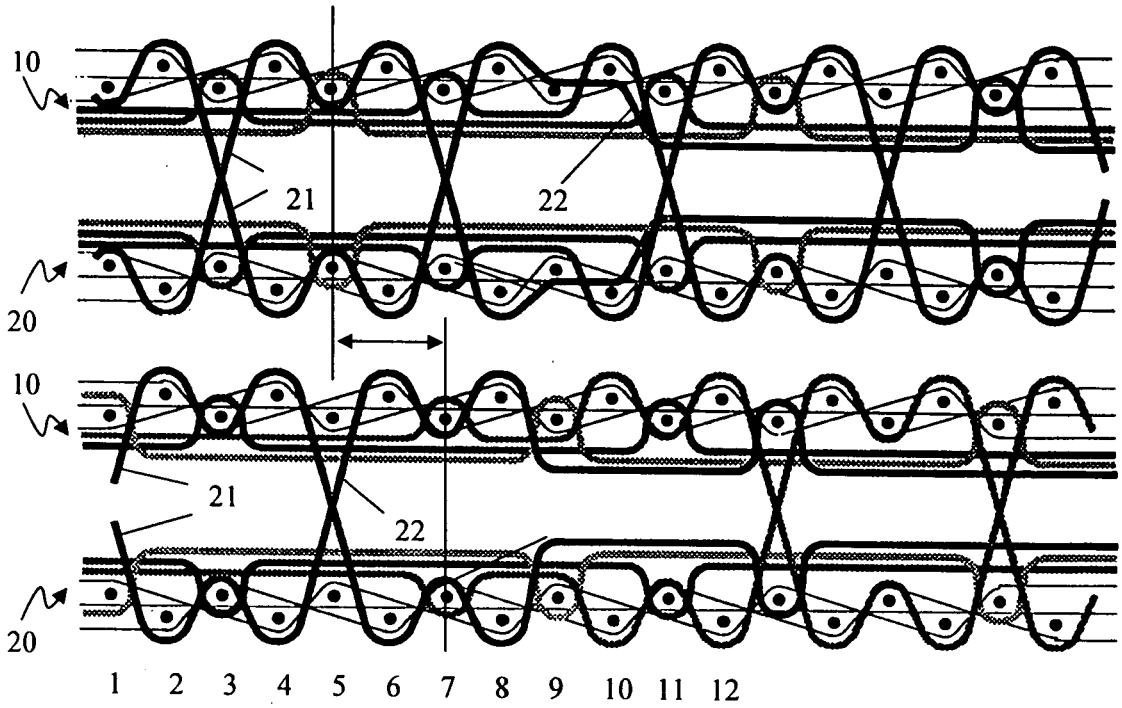
FIG. 12 represents the diagrammatic cross section of shaggy fabrics woven in opposite phase by means of a process according to the invention, the weave pattern in mutually adjacent reed dents being displaced over a few wefts.

The equality which is already found in areas of the fabrics (10), (20) woven in opposite phase can be further increased by displacing the weave pattern in mutually adjacent reed dents (A), (B) over a few wefts (5-7), as is represented in FIG. 12. Here, the displacement preferably occurs over a number of wefts, in which case, if the figuring pile warp yarns (21), (22) in the one reed dent (A) move between bottom fabric (20) and top fabric (10), the corresponding pile warp yarns in the neighbouring reed dent (B) form the middle leg of a W.

Figure 13:
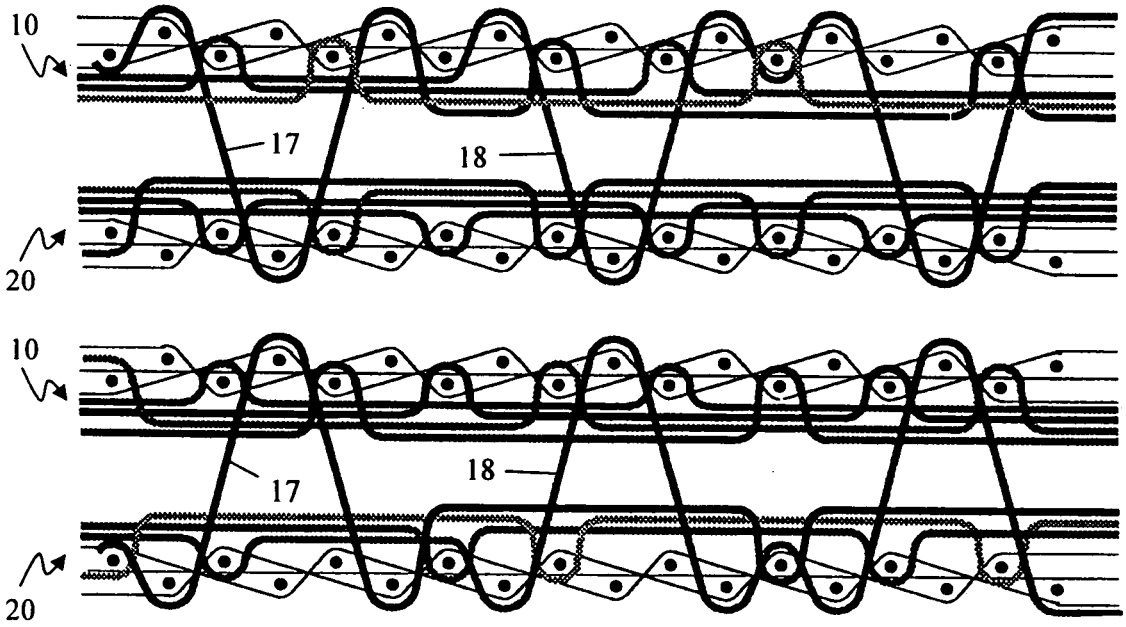
FIG. 13 represents the diagrammatic cross section of shaggy fabrics woven with a combination of the 1/4 V-weave and the 3/8 W-weave by means of a process according to the invention.

New weaves which are readily usable in combination with the process according to the invention are weaves whereof the figuring for the top fabric (10) takes place according to a weave having a specific k-value according to one of the formulae $2k+3/2(2k+3)$ and $2k+1/4(k+1)$, wherein $k \geqq 0$, and the figuring in the bottom fabric (20) takes place according to a weave having a different k-value according to the same formula. FIG. 13 shows this for the 3/8 W-weave in combination with the 1/4 V-weave. If this combination is used in reverse in the neighbouring reed dent, i.e. 1/4 V-weave in combination with a 3/8 W-weave, in areas in the fabric in which this combination is used a different pile density can be achieved than with each of the weaves according to the separate formulae. Still further variation can thereby be brought to the fabric.

Figure 14:
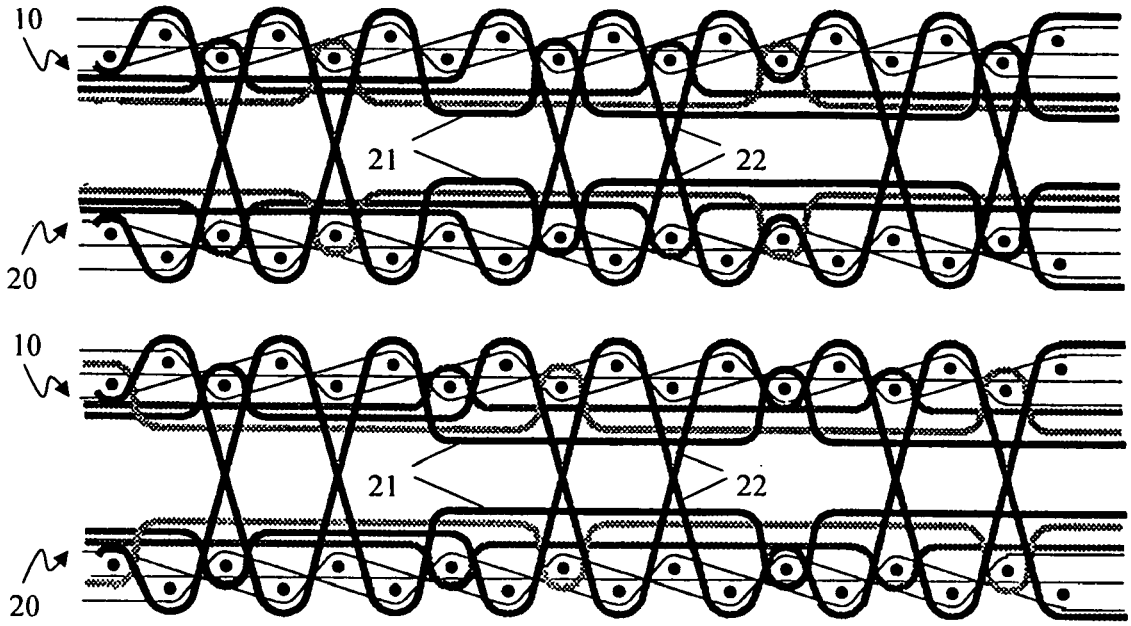
FIG. 14 represents the diagrammatic cross section of shaggy fabrics woven with a combination of the 1/4 V-weave and the 3/8 W-weave in opposite phase by means of a process according to the invention.

As is represented in FIG. 14, this combination can also be applied in opposite phase, so that, for each pile warp yarn (21), (22) which moves in the top fabric (10) or moves between the top fabric (10) and the bottom fabric (20), a corresponding pile warp yarn with the same characteristic performs the opposite movement in the bottom fabric (20), or between the bottom fabric (20) and the top fabric (10).

Figure 15:
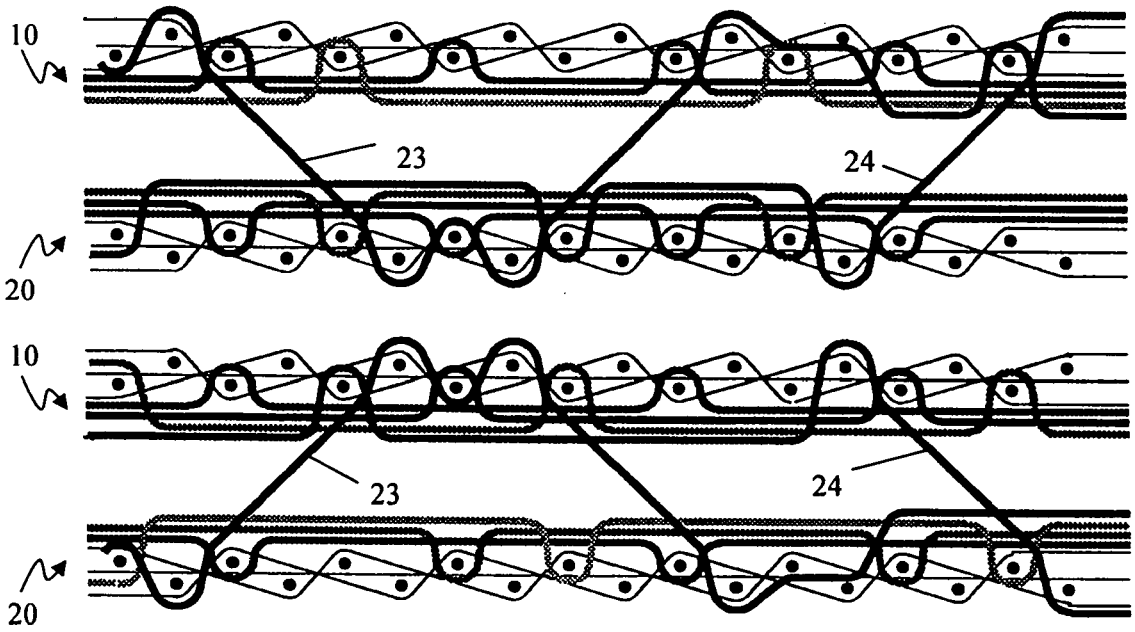
FIG. 15 represents the diagrammatic cross section of shaggy fabrics, the transition from figuring of a pile warp yarn in the top fabric to figuring in the bottom fabric running over one or more extra wefts.

Another variant, as is represented in FIG. 15, which allows additional effects to be created in the shaggy fabric, consists in, in one of the weaves according to the formula 2k+1/4(k+1), wherein k≧0 and k is a whole number, making the transition from figuring of a pile warp yarn (23), (24) in the top fabric (10) to figuring in the bottom fabric (20) run over one or more extra wefts, so that the pile length of the figuring pile warp yarn (23), (24) between interlacing in the top fabric (10) and interlacing in the bottom fabric (20) becomes longer than if weaves according to one of the formulae 2k+1/4(k+1), wherein k≧0 and k is a whole number, are used, which yields the advantages previously stated.

Figure 16:
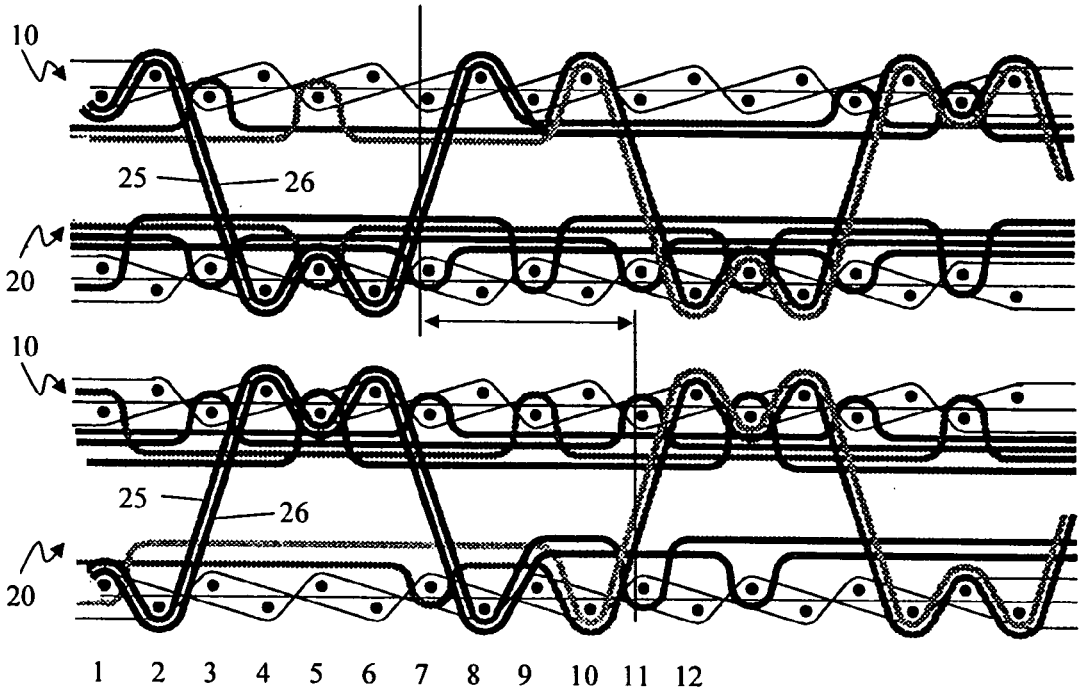
FIG. 16 represents a diagrammatic cross section of the weave in the production of shaggy fabrics, two pile warp yarns with a different characteristic being simultaneously selected.
Figure 17:
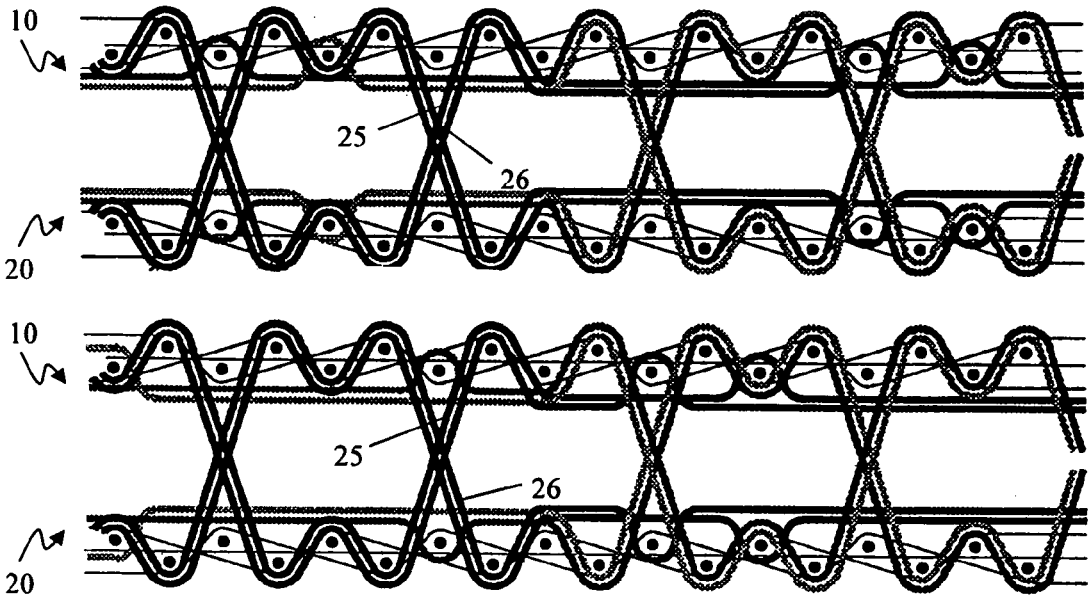
FIG. 17 represents the diagrammatic cross section of the weave as represented in FIG. 16 in the production of shaggy fabrics woven in opposite phase.

In one or more warp yarn systems, yarns of the same color but of different thickness and/or a different sort of yarn can also be used. In addition, yarns of the same color can also be used, but which react differently to a subsequent treatment such as, for example, shrinkage, crimping, etc. These yarns of the same color but with other differential characteristics can then be selected according to a pattern, whether simultaneously or not. In FIG. 16, a weave is represented where two such pile warp yarns (25), (26) are simultaneously selected and in a first reed dent (A) and in the neighboring second reed dent (B) the pile-forming portion of the weave pattern lies displaced over a number of wefts corresponding to half of the wefts over which the weave pattern is repeated. In FIG. 16, the weave pattern is a 3/8 W-weave and the pile-forming portion of the weave pattern is displaced over 4 wefts, i.e. from weft 7 to weft 11. FIG. 17 represents the weave according to FIG. 16, but constructed in opposite phase. In the state of the art, such effects have to be produced by using a composite yarn, wherein a thin and a thick yarn, for example, are combined into one yarn. In such a case, less effect is possible, because both yarn types are always used in combination and cannot be used independently from one another in the formation of the weaving pattern. This problem is resolved by conducting a process on a double-face weaving machine according to the invention.

If the combination of such yarn types is desired over the entire fabric, however, the choice can also be made to make both yarn types move from separate bobbins in the weaving creel through the same heddle, which is operated by a single harness element. This renders an additional operation to combine the two yarn types into one yarn superfluous.

The difference between the existing shaggy fabrics and the shaggy fabrics according to the invention is that the latter according to the invention are woven in a plurality of colors (or characteristics) on a double-face weaving machine. The solution of weaving shaggy fabrics with a double-face weaving machine makes it possible also to use plastic and polypropylene yarns to produce such fabrics.

In the case of a shaggy fabric which is woven by means of a process according to the invention, in the fabric, in mutually adjacent warp yarn systems, the pile-forming portion of the weave pattern can lie displaced over a plurality of wefts one relative to the other. The displacement is here preferably equal to half of the wefts over which the weave pattern is repeated, as is represented in FIGS. 4 to 9. For a 3/8 W-weave (FIG. 8), the W-formation in each of the fabrics (10), (20) in mutually adjacent warp yarn systems, which generally is conform to mutually adjacent reed dents, (A), (B), will lie displaced over 4 wefts (7-11).

For the sake of the thickness of the pile warp yarns, the pile warp yarns are rarely inwoven between the base warp yarns of the ground fabrics of the shaggy fabrics, but they are in many cases provided floating on the pile side on the ground fabric of the shaggy fabric, and they are interlaced at regular intervals over a weft which, in relation to the tension warp yarn of the ground fabric, is located on the pile side of the fabric.

In order to reach the middle position for floating over a plurality of wefts, on the one hand open-shed jacquard devices can be used, which can assume any position on every weft insertion cycle. On the other hand, it is also possible to operate with a jacquard device which can only reach the middle position over a plurality of weft insertion cycle and which additionally can move from the middle position on the one weft insertion cycle to the topmost or the bottommost position, and on the following weft insertion cycle back to the middle position.

Since, as previously mentioned here, when weaving is conducted in opposite phase, for each movement of a pile warp yarn a corresponding pile warp yarn with the same characteristic performs a counter-movement, a jacquard device can be used in which each movement of a pile warp yarn is coupled by an active selection of one or more selection elements to opposite movement of the corresponding pile warp yarn, for example by a mechanical coupling, so that, for the movement of this corresponding pile warp yarn, no selection by one or more selection elements is any longer necessary. These weaves can thereby be realized with a jacquard device having only half the number of selection elements.

The invention claimed is:

1. Process for weaving fabrics on a weaving machine, wherein these fabrics comprise a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application, and are inwoven or float along the fabric for non-figuring application, a bottommost and a topmost fabric (20), (10) are woven according to a double-face weaving method, and the said two mutually adjacent warp yarn systems each comprise the same at least two pile warp yarns (17), (18), (21), (22), (23), (24), (25), (26), in which case, if the one pile warp yarn in the first warp yarn system (17), (21), (23), (25) in non-figuring application, floats or is inwoven in the top fabric (10) or in the bottom fabric (20), the corresponding pile warp yarn from the other warp yarn system (17), (21), (23), (25), in non-figuring application, floats or is inwoven in the bottom fabric (20) or in the top fabric (10).

2. Process for weaving fabrics on a weaving machine, wherein these fabrics comprise a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application, and are inwoven or float along the fabric for non-figuring application, a bottommost and a topmost fabric (20), (10) are woven according to a double-face weaving method, and the said two mutually adjacent warp yarn systems each comprise the same at least two pile warp yarns (17), (18), (21), (22), (23), (24), (25), (26), in which case, if the one pile warp yarn in the first warp yarn system (17), (21), (23), (25) in non-figuring application, floats or is inwoven in the top fabric (10) or in the bottom fabric (20), the corresponding pile warp yarn from the other warp yarn system (17), (21), (23), (25), in non-figuring application, floats or is inwoven in the bottom fabric (20) or in the top fabric (10) wherein the fabrics (10), (20) are woven by means of weaves according to the formula 2k+3/2(2k+3), wherein k>0 and is a whole number.

3. Process for weaving fabrics on a weaving machine, wherein these fabrics comprise a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application, and are inwoven or float alone the fabric for non-figuring application, a bottommost and a topmost fabric (20), (10) are woven according to a double-face weaving method, and the said two mutually adjacent warp yarn systems each comprise the same at least two pile warp yarns (17), (18), (21), (22), (23), (24), (25), (26), in which case, if the one pile warp yarn in the first warp yarn system (17), (21), (23), (25) in non-figuring application, floats or is inwoven in the top fabric (10) or in the bottom fabric (20), the corresponding pile warp yarn from the other warp yarn system (17), (21), (23), (25), in non-figuring application, floats or is inwoven in the bottom fabric (20) or in the top fabric (10) wherein the fabrics (10), (20) are woven by means of weaves according to the formula 2k+1/4(k+1), wherein k>0 and is a whole number.

4. Process according to claim 2, wherein the figuring for the top fabric (10) is realized according to a weave having a specific k-value according to one of the said formulae, and the figuring for the bottom fabric (20) being realized according to a weave having a differing k-value according to the same formula.

5. Process according to claim 2, characterized in that in the weave the transition from figuring of a pile warp yarn (23), (24) in the top fabric (10) to figuring of this pile warp yarn (23), (24) in the bottom fabric (20) is displaced over one or more extra wefts, the pile warp yarn at each of these extra wefts being placed in a middle position between the weft insertion levels.

6. Process according to claim 2, characterized in that one warp yarn system extends through one reed dent (A) or (B) of the reed of the weaving machine.

7. Process according to claim 2, characterized in that in at least two mutually adjacent warp yarn systems, in each of these warp yarn systems for one or more pile warp yarns, a pile warp yarn with the same characteristics is present, whereby weaving can be conducted in opposite phase.

8. Process according to claim 3, characterized in that in at least two mutually adjacent warp yarn systems, in each of these warp yarn systems, for each pile warp yarn a pile warp yarn with the same characteristics is present, whereby weaving can be conducted fully in opposite phase.

9. Process according to claim 7, characterized in that the weave pattern in mutually adjacent warp yarn systems is displaced over one or more wefts.

10. Process according to claim 9, characterized in that the weave pattern in mutually adjacent warp yarn systems (A), (B) is displaced over a number of wefts, in which case, if the figuring pile warp yarns (21), (22) in the first warp yarn system move between the bottom fabric (20) and the top fabric (10), in the adjoining warp yarn system (B), (A) the figuring pile warp yarns (21), (22) form the middle leg of the W-weave pattern.

11. Process for weaving fabrics on a weaving machine, wherein these fabrics comprise a plurality of warp yarn systems, wherein for at least two mutually adjacent warp yarn systems, in each of these at least two mutually adjacent warp yarn systems, at least two pile warp yarns with different characteristics are present, and wherein in each of the said warp yarn systems the pile warp yarns are interlaced alternately in the fabric, according to a pattern, for figuring application, and are inwoven or float along the fabric for non-figuring application, a bottommost and a topmost fabric (20), (10) are woven according to a double-face weaving method, and the said two mutually adjacent warp yarn systems each comprise the same at least two pile warp yarns (17), (18), (21), (22), (23), (24), (25), (26), in which case, if the one pile warn yarn in the first warp yarn system (17), (21), (23), (25) in non-figuring application, floats or is inwoven in the top fabric (10) or in the bottom fabric (20), the corresponding pile warp yarn from the other warp yarn system (17), (21), (23), (25), in non-figuring application, floats or is inwoven in the bottom fabric (20) or in the top fabric (10) wherein the pile warp yarns (17), (18), (21), (22), (23), (24), (25), (26) in the fabrics (10), (20) float on the pile side of the fabrics (10), (20) and are interlaced at regular intervals over a weft which is located, in relation to the tension warp yarn consisting of the base fabric of the fabric, on the pile side of the fabric.

12. Process according to claim 5, characterized in that in order to reach the middle position in a plurality of successive positions, open-shed jacquard devices are used which can assume any position on every weft.

13. Process according to claim 5, characterized in that in order to reach the middle position in a plurality of successive positions, a jacquard device is used which can only reach the middle position over a plurality of weft insertion cycles and which can move from the middle position on the one weft insertion cycle to the topmost or bottommost position, and on the following weft insertion cycle moves back to the middle position.

14. Process according to claim 8, characterized in that a jacquard device is used in which each movement of a pile warp yarn (17), (18), (21), (22), (23), (24), (25), (26) is coupled, by an active selection of one or more selection elements of the jacquard device, to an opposite movement of a pile warp yarn (17), (18), (21), (22), (23), (24), (25), (26) with the same characteristic, so that, for the movement of this pile warp yarn (17), (18), (21), (22), (23), (24), (25), (26) with the same characteristic, no selection by one or more selection elements needs to be made.

15. Shaggy fabric on a double-face weaving machine woven by means of a process according to claim 11.

16. Shaggy fabric according to claim 15, characterized in that in the fabric in mutually adjacent warp yarn systems the pile-forming portion of the weave pattern lies displaced over a plurality of wefts one relative to the other.

17. Shaggy fabric according to claim 16, characterized in that the said displacement in mutually adjacent warp yarn systems is equal to half the number of wefts over which the weave pattern is repeated.

* * * * *

UNITED STATES PATENT AND TRADEMARK OFFICE

CERTIFICATE OF CORRECTION

PATENT NO. : 7,287,552 B2
APPLICATION NO. : 11/290616
DATED : October 30, 2007
INVENTOR(S) : Johny Debaes and Marc Delepierre It is certified that error appears in the above-identified patent and that said Letters Patent is hereby corrected as shown below:

Title Page

Item (73) Assignee, should read:

N.V. Michel Van de Wiele

Signed and Sealed this

Twenty-fifth Day of December, 2007

JON W. DUDAS
*Director of the United States Patent and Trademark Office*